US007138085B2

(12) United States Patent
Ohrt et al.

(10) Patent No.: US 7,138,085 B2
(45) Date of Patent: Nov. 21, 2006

(54) TUYERE COOLING SYSTEM

(75) Inventors: Herman Ohrt, Collingwood (CA); Lou Gecan, deceased, late of Grimbsby (CA); by Jennifer Gecan, legal representative, Grimsby (CA)

(73) Assignee: Dofasco Inc., Hamilton (CA)

( * ) Notice: Subject to any disclaimer, the term of this patent is extended or adjusted under 35 U.S.C. 154(b) by 0 days.

(21) Appl. No.: 10/998,841

(22) Filed: Nov. 30, 2004

(65) Prior Publication Data

US 2005/0206051 A1 Sep. 22, 2005

Related U.S. Application Data

(63) Continuation of application No. PCT/CA03/00766, filed on May 29, 2003.

(60) Provisional application No. 60/383,777, filed on May 30, 2002.

(51) Int. Cl.
*C21B 7/16* (2006.01)

(52) U.S. Cl. ..... 266/270; 266/265

(58) Field of Classification Search ..... 266/265, 266/270

See application file for complete search history.

(56) References Cited

U.S. PATENT DOCUMENTS

| | | | | |
|---|---|---|---|---|
| 3,540,418 | A | * | 11/1970 | Peel ..... 266/270 |
| 3,599,952 | A | | 8/1971 | Slagley |
| 3,693,961 | A | | 9/1972 | Preisendanz et al. |
| 3,712,602 | A | | 1/1973 | Brown et al. |
| 5,989,488 | A | | 11/1999 | Hori |

FOREIGN PATENT DOCUMENTS

| | | | | |
|---|---|---|---|---|
| GB | 269783 | A | | 4/1927 |
| GB | 2047860 | A | | 12/1980 |
| JP | 53-048006 | A | | 5/1978 |
| JP | 56-127715 | A | | 10/1981 |
| JP | 58-120706 | A | | 7/1983 |
| JP | 58-204109 | A | | 11/1983 |
| JP | 07-216421 | A | | 8/1995 |
| JP | 07-228907 | A | | 8/1995 |
| JP | 10-169942 | | * | 6/1998 |
| JP | 2000212617 | A | | 8/2000 |

OTHER PUBLICATIONS

English language Translation of JP 10-169942, Jun. 1998.*

* cited by examiner

*Primary Examiner*—Scott Kastler
(74) *Attorney, Agent, or Firm*—John R. S. Orange; Brett J. Slaney; Sean X. Zhang

(57) ABSTRACT

A tuyere cooling system which includes a coolant circuit for a body section and nose section. A valve is operable to connect the coolant circuits in series or to disconnect flows to the nose section of the tuyere so that if the nose of the tuyere tears during operation, the flow of coolant to the nose section of the tuyere may be cut off without affecting the overall operation of the blast furnace.

9 Claims, 5 Drawing Sheets

TUYERE COOLING SYSTEM

This application is a continuation of PCT application No. PCT/CA03/00766 filed on May 29, 2003, which claims priority from U.S. provisional application No. 60/383,777 filed on May 30, 2002 the contents of which are incorporated herein by reference.

FIELD OF THE INVENTION

The present invention relates in general to tuyeres, and, more specifically, to a tuyere cooling system.

DESCRIPTION OF THE PRIOR ART

The use of blast furnaces in the manufacture of metals has been well known for many years. Blast furnaces generally include a blowpipe which connects a hot-blast system with a tuyere which blows hot air into the hearth of the blast furnace. However, due to the high temperature (around 1100° C.) of the hot-blast system, the tuyere is required to be cooled during use in order to protect it from being overheated.

In prior art tuyere cooling systems which only require one water circuit, if the nose section tears or breaks, the entire water circuit must be shut down to avoid letting any water enter the hearth of the furnace and subsequently the entire furnace is shut down since there is no cooling for the tuyere. This causes a delay in the manufacturing process while the tuyere is replaced.

Alternatively, the tuyere is cooled using two separate water circuits. One water circuit is used to cool the nose section of the tuyere while a second water circuit is used to cool the remaining tuyere body. In this manner, if the nose of the tuyere tears off during operation, the high pressure water circuit may be immediately turned off to prevent water from entering the hearth while operation of the blast furnace continues. While the air continues to be blasted into the hearth, the body of the tuyere is cooled by the lower pressure water circuit. However, by requiring two separate water circuits, the cost for operating a blast furnace is increased since each water circuit requires a separate set of pumps, heat exchangers, piping and controls for Therefore, it is an object of the present invention to obviate or mitigate some of the above-described disadvantages.

SUMMARY OF THE INVENTION

A tuyere comprises a body section, a nose section and a cooling system. The cooling system includes a first coolant passageway extending through said body section and having an inlet and an outlet A second coolant passageway extending through the nose section and has an inlet and an outlet, and a valve assembly operable in a first condition to connect the coolant passageways in series so that coolant flows sequentially through the sections and operable in a second condition to inhibit flow through one of the passageways whilst maintaining flow in another.

BRIEF DESCRIPTION OF THE DRAWINGS

An embodiment of the invention will now be described by way of example only with reference to the appended drawings wherein.

DESCRIPTION OF THE PREFERRED EMBODIMENTS

Figure 1:
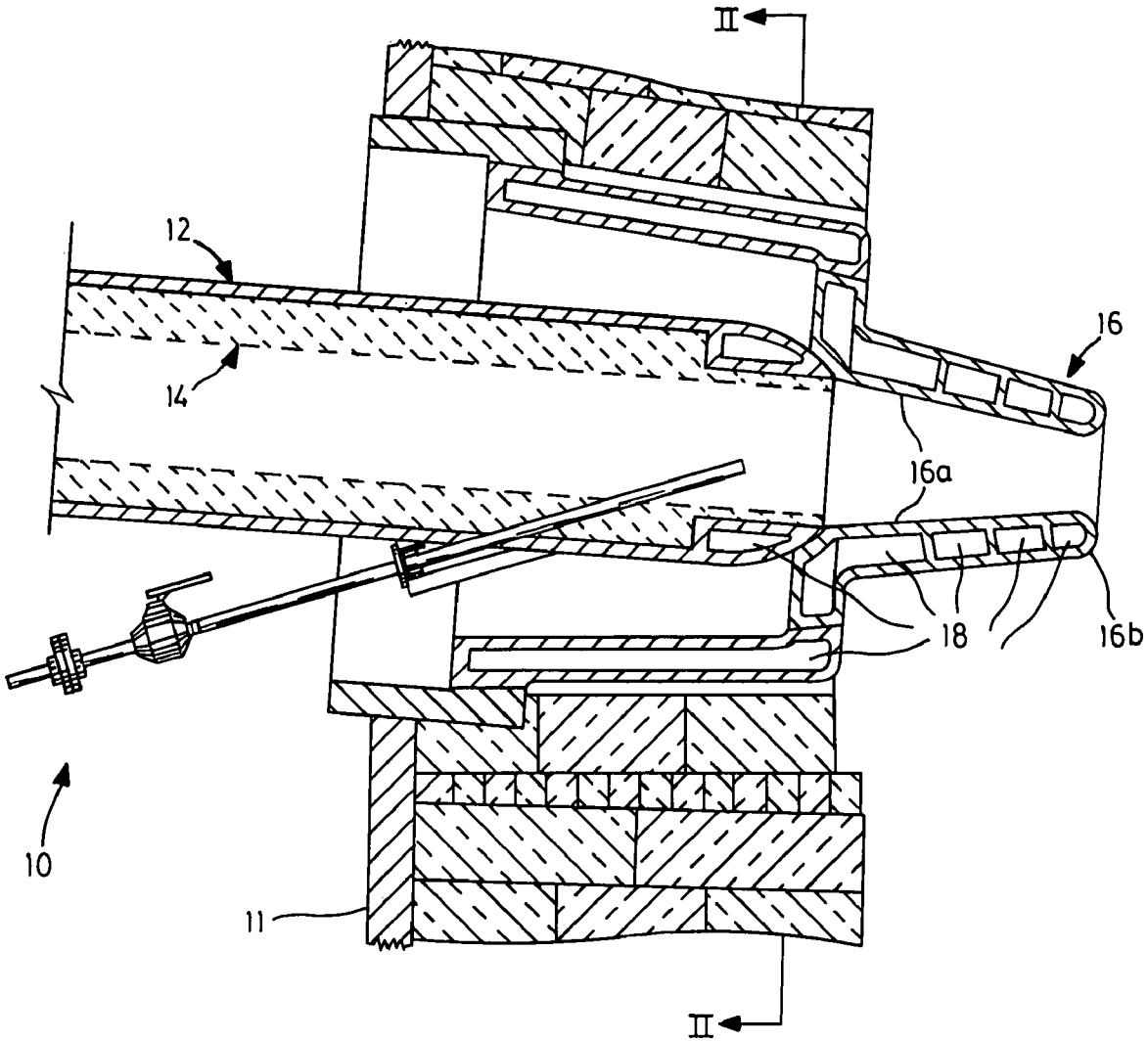
FIG. 1 is a sectional view of a tuyere and blowpipe assembly.
Figure 2:
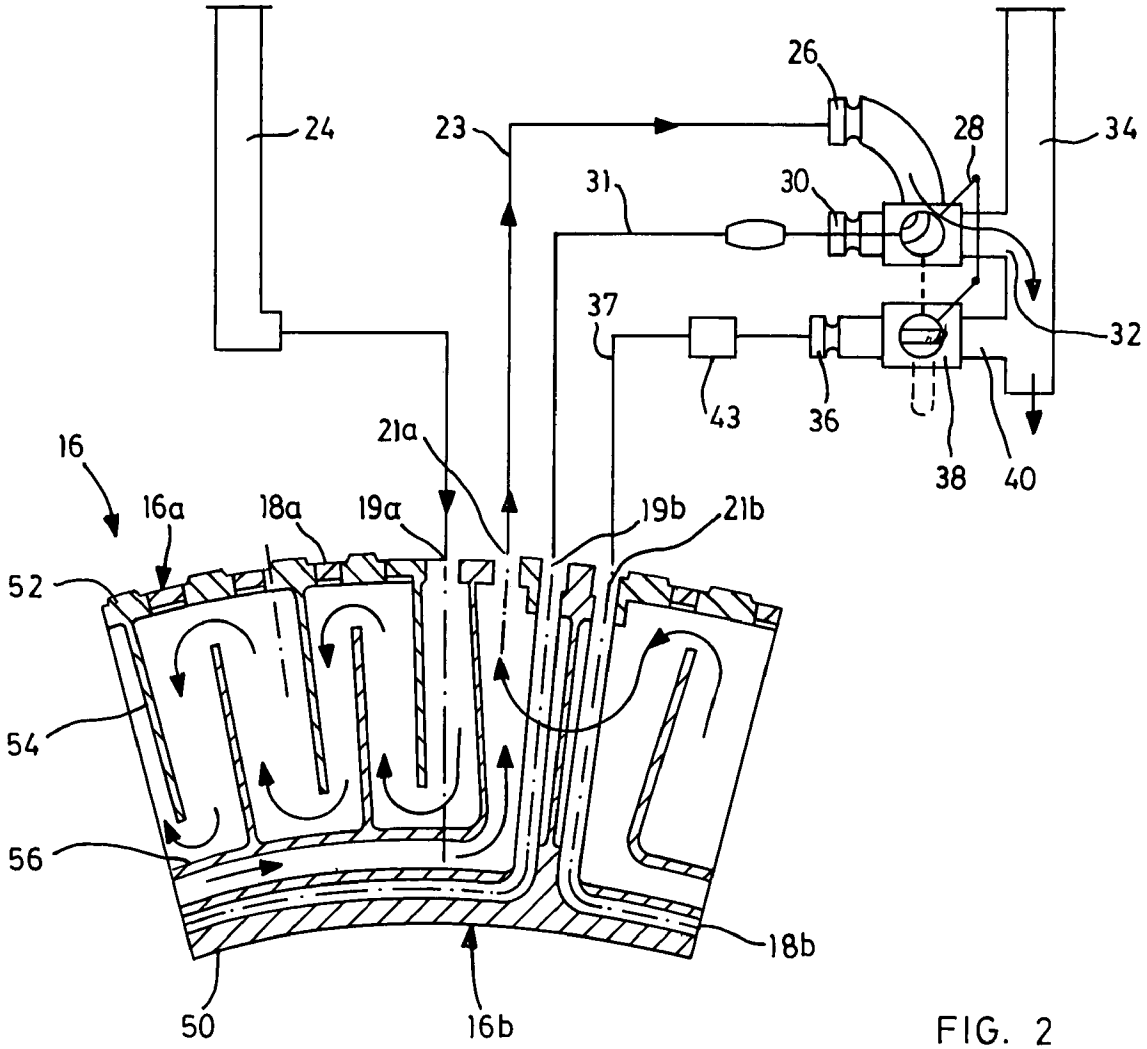
FIG. 2 is a section view taken along the line II—II of FIG. 1.
Figure 3:
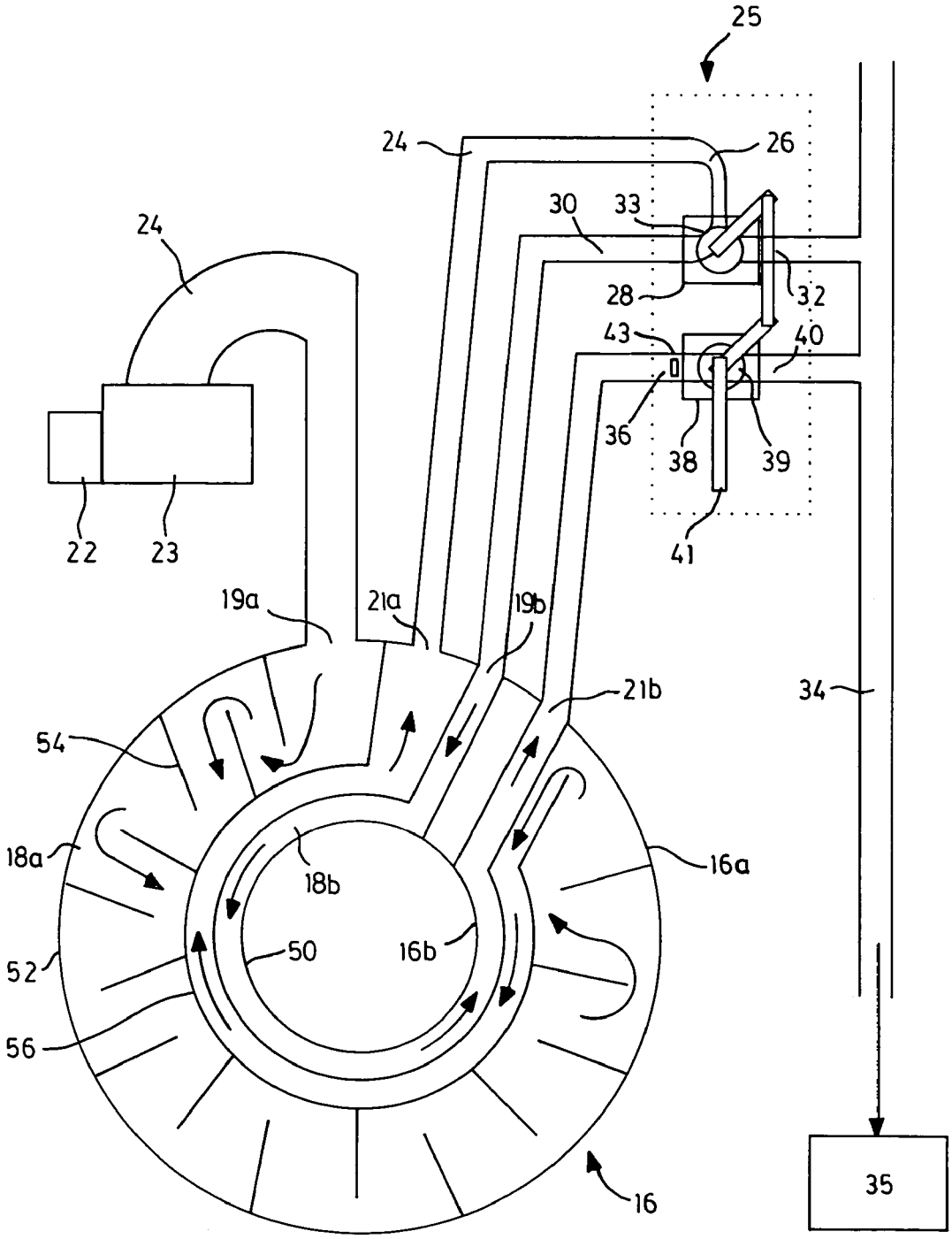
FIG. 3 is a schematic diagram of a tuyere cooling system with the valves in a first position.

Turning to FIG. 1, a tuyere and blowpipe assembly 10, located within a wall 11 of a blast furnace, includes a blowpipe 12 with a ceramic lining 14 to introduce air into the furnace. The blowpipe 12 is connected to a tuyere 16 which is mounted in the wall 11. The tuyere 16 generally comprises a body section 16*a* and a nose section 16*b*. Passageway 18 within the tuyere 16 allows a fluid coolant, such as water, to pass through and cool the tuyere 16 during operation of the blast furnace. As shown in FIGS. 2 and 3, the passageway 18 is subdivided into two sets, a body passageway 18*a* for cooling the body section 16*a* and a nose passageway 18*b* for cooling the nose section 16*b*.

As may be more clearly seen in FIG. 3, body passageway 18*a* has an inlet 19*a* and an outlet 21*a* and forms a separate path through the body 16*a* of the tuyere while nose passageway 18*b* suitably has an inlet 19*b* and an outlet 21*b* and is located as an annular passage at the nose 16*b* of the tuyere 16. The passageway 18*a* is formed between inner and outer shells 50, 52 of the body section 16*a* by radial partitions 54. The partitions 54 terminate alternately adjacent the outer shells 52 and an internal wall 56 concentric to the inner shell 50 to define a serpentine flow path circumferentially around the body section 16*a*. The internal wall 56 and inner shell 50 define an annular return path for contra flow within the nose section 16*b*.

The inlet 19*a* of the body passageway 18*a* is connected, by a supply conduit 24, to a coolant source 22 which provides a fluid coolant via pump 23 for cooling the tuyere 16. The outlet 21*a* of the body passageway 18*a* is connected by a pipe 23 to a valve assembly 25 comprising a three-way valve 28 and a two-way valve 38, both controlled by an operating mechanism 41. The coolant flows from the outlet 21*a* to an input 26 of the three-way valve 28 which has two outputs 30 and 32. One of the outputs 30 of the three-way valve 28 is connected by pipe 31 with the inlet 19*b* of the nose passageway 18*b* while the other output 32 is connected to a coolant discharge 34 which leads to a reservoir 35. The direction of the fluid coolant flow is controlled by a rotatable valve member 33.

The outlet 21*b* of the nose passageway 18*b* is connected by a pipe 37 to input 36 of a two-way valve 38 while the output 40 of the two-way valve 38 is connected to the coolant discharge 34 leading to the reservoir 35 The flow of the fluid coolant within the two-way valve 38 is controlled by a rotatable valve member 39.

A pressure relief valve 43 may also be installed at the input 36 of the two-way valve 38. The pressure relief valve 43 is used to monitor the pressure within the cooling system and if the pressure reaches a predetermined maximum limit, the pressure relief valve 43 provides an outlet for the excess pressure to be released. Furthermore, the relief valve 43 may be used for testing purposes. Air pressure may be introduced to the system using the relief valve as an input so that leaks within the system may be identified.

Figure 4:
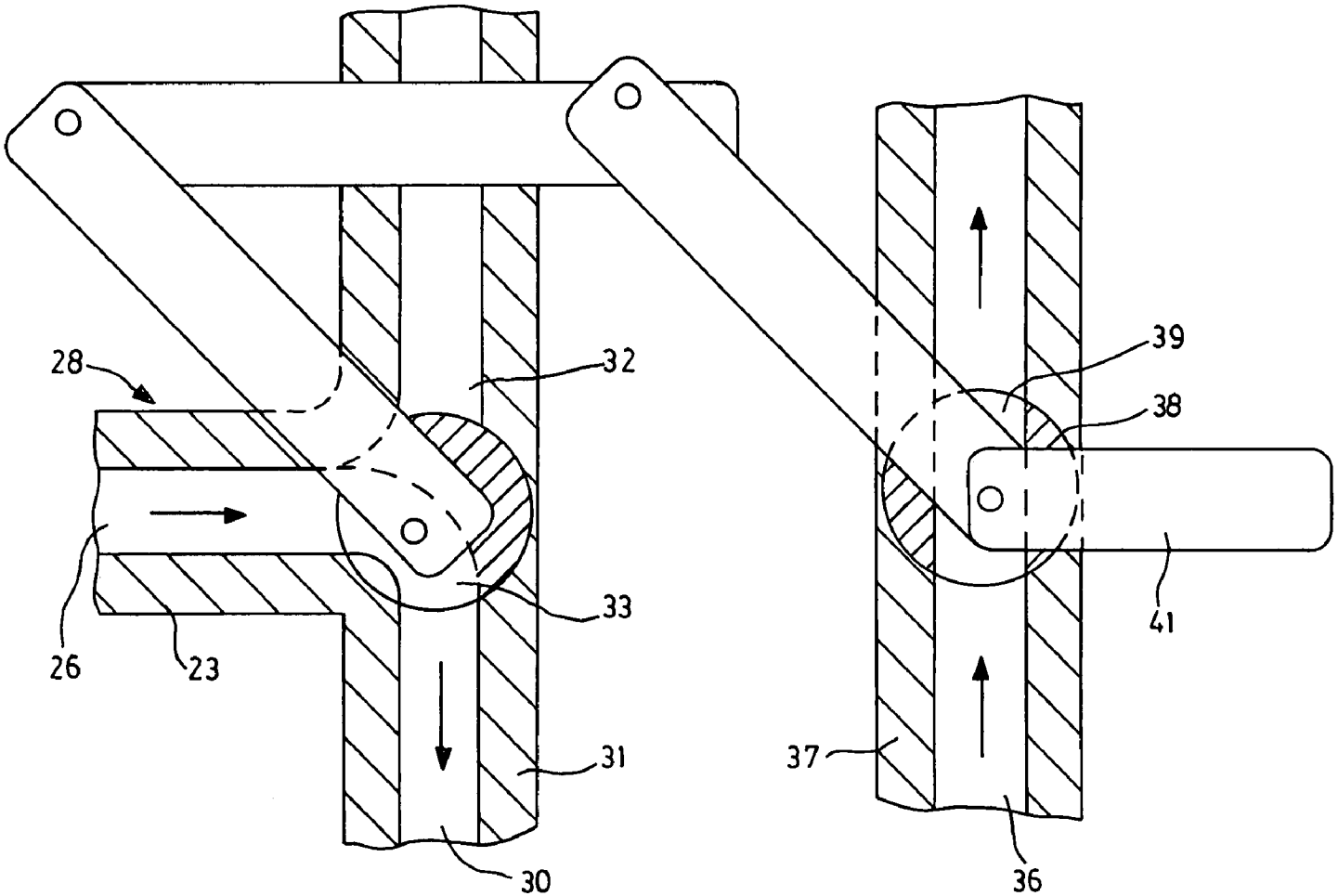
FIG. 4 is an enlarged view of a portion of the cooling system shown in FIG. 3 with valves in the first position.
Figure 5:
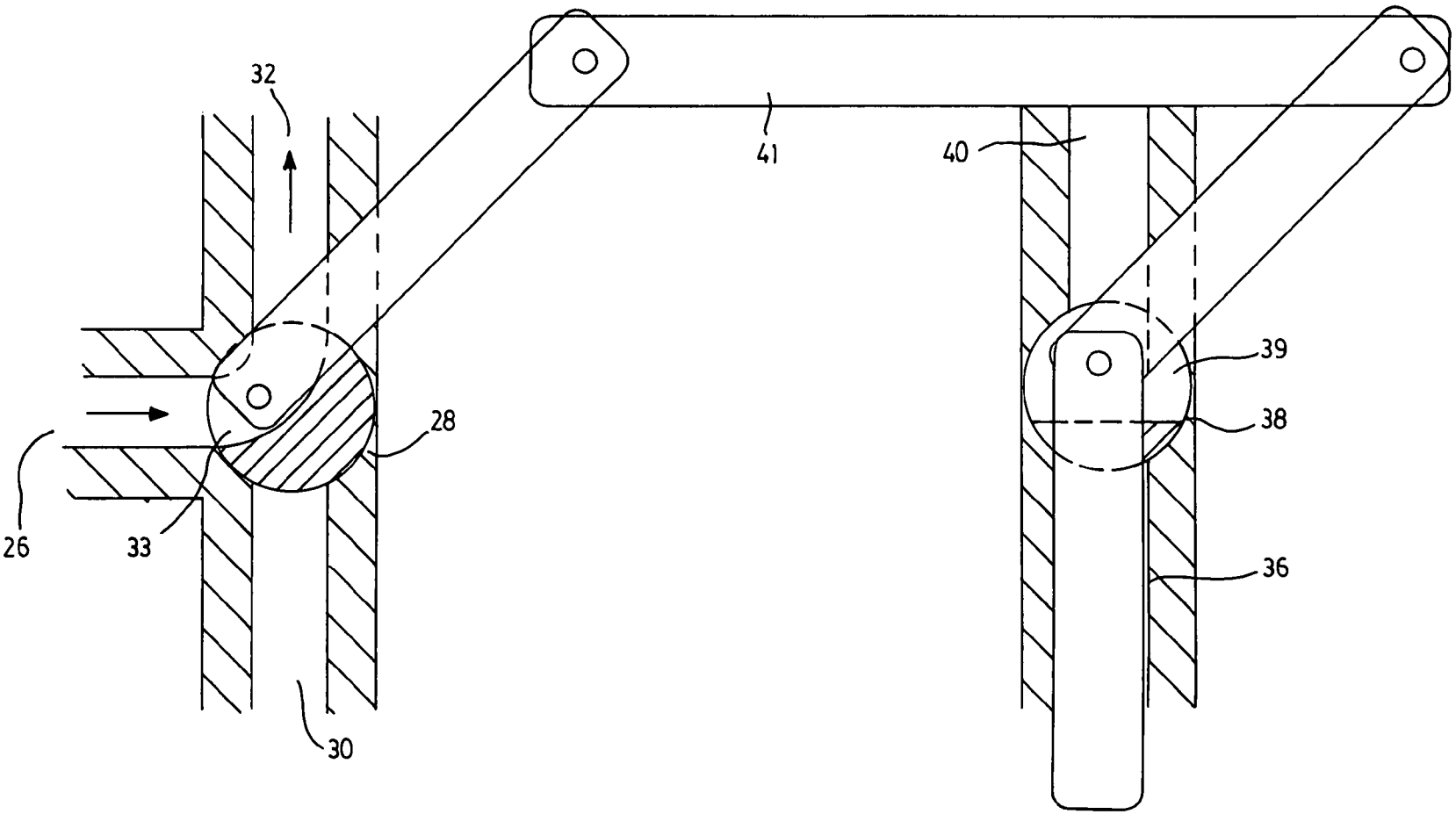
FIG. 5 is a view similar to FIG. 4 with valves in the second position.

The alternate positions of the rotational valve member 33 and 39 in the first and second positions are respectively shown in FIGS. 4 and 5. In the first position (FIG. 4), rotational valve member 33 is placed so that it may receive the fluid coolant from the input 26 and direct the fluid coolant back through output 30 to the inlet 19*b* of nose passageway 18*b* of the tuyere 16. Likewise, the rotational valve member 39 is located such that the fluid coolant from the outlet of the nose passageway 18*b* flows from the input 36 to the coolant discharge 34 via the output 40.

In the second position (FIG. 5), the rotational valve member 33 is positioned so that the fluid coolant from the outlet 21*a* of the body passageway 18*a* is directed from the input 26 to the coolant discharge 34, via the output 32. Meanwhile, rotational valve member 39 is positioned so that no fluid coolant flows from the outlet 21*b* to the coolant discharge 34.

Conjoint Movement of the valve members 33, 39 between the first and second positions is provided by the operating mechanism 41 that includes levers 60, 62 connected to valve members 33, 39. The levers 60, 62 are connected by a link 64 and a handle 66 is connected to one of the levers 60.

In operation, the fluid coolant is pumped from the coolant source 22 to the inlet 19*a* of the body passageway 18*a*. The coolant flows through the body of the tuyere 16 to cool the body section 16*a*. After the fluid coolant has passed through the body section 16*a*, the fluid coolant exits the body section 16*a* via the outlet 21*a* and flows to the input 26 of the three-way valve 28. Since the valves are in the first position, the fluid coolant is then directed by the rotatable valve member 33 back to the inlet 19*b* of the nose passageway 18*b* via output 30. The fluid coolant then flows around the nose section 16*b* and exits via the outlet 21*b* and flows to the input 36 of the two-way valve 38. The fluid coolant is then directed by the rotational valve member 39 to the coolant discharge 34. The fluid coolant then flows within the coolant discharge 34 to the reservoir 35 whereby the coolant is preferably cooled and returned to the coolant source 22. Reverse flow past the valve 28 to the outlet 30 is prevented.

If the nose section 16*b* of the tuyere 16 tears off or leaks during operation, the handle 60 is rotated so that the rotational valve members 33 and 39 cause the valves 28 and 38 to be placed in the second position shown in FIG. 5 so that fluid coolant flow to the nose section 16*b* is cut off. However, the body section 16*a* of the tuyere 16*b* will still be cooled by the fluid coolant.

In the second position (as shown in FIG. 5), the fluid coolant is pumped into the inlet 19*a* of the body passageway 18*a* from the source 22 and flows around the body section 16*a* as shown by arrows 42. After exiting the outlet 21*a* of the body passageway 18*a*, the fluid coolant flows to the input 26 of the three-way valve 28. In this second position, the rotational valve member 33 directs the fluid coolant to the coolant discharge 34 via the output 32. The fluid coolant then flows to the coolant discharge 34 and subsequently to the reservoir 35 where the fluid coolant may be cooled before being sent back to the source 22. Since the nose section has been torn, no fluid coolant flows from the outlet 21*b* of the nose passageway 18*b* to the input 36 of the two-way valve 38. Reverse flow from the discharge is prevented by the valve 38. By placing the valves in the second position, the flow rate of the fluid coolant flowing in the body section 16*a* is increased because of the coolant path. When the valves are rotated from the first position to the second position, the flow of fluid coolant through the body passageway 18*a* is uninterrupted, so as to maintain cooling of the body.

It will be appreciated that the valve member 39 essentially operates as a check valve to inhibit flow from the discharge 34 to the nose section cooling passage 34*b*. Accordingly, a check valve may be used in place of the rotary valve 38 where conditions permit. Alternatively, the discharge from the valves 28, 38 may be separated to remove the possibility of a reverse flow and obviate the need for the valve 38. Conjoint operation of the valve members 33, 39 may be achieved automatically by electrical or hydraulic operators if required although the simplicity of a manual valve is preferable in most installations.

By using a single water circuit to cool the tuyere, the cost of the tuyere cooling system may be reduced. Furthermore, if the nose section of the tuyere tears or leaks during operation, the entire furnace does not have to be shut down to repair the tuyere, instead, the tuyere may be replaced at a more convenient time such as a scheduled furnace shutdown for maintenance.

Although the invention has been described with reference to certain specific embodiments, various modifications thereof will be apparent to those skilled in the art without departing from the spirit and scope of the invention as outlined in the present application.

The embodiments of the invention in which an exclusive property or privilege is claimed are defined as follows:

1. A tuyere comprising a body section, a nose section and a cooling system, said cooling system including a first coolant passageway extending through said body section and having an inlet and an outlet, a second coolant passageway extending through said nose section and having an inlet and an outlet, and a valve assembly operable in a first condition to connect said coolant passageways in series with an outlet of one of said passageways connected to an inlet of another of said passageways so that coolant flows sequentially through said sections and operable in a second condition to inhibit flow through said second of said passageways whilst maintaining flow in said first coolant passageway and thereby cooling said body section.

2. A tuyere according to claim 1 wherein said valve assembly is operable in said first condition to connect said outlet of said first coolant passageway with said inlet of said second coolant passageway.

3. A tuyere according to claim 1 wherein said valve assembly includes a first valve to control flow between said passageways and a second valve to control flow from one of said outlets to a discharge.

4. A tuyere according to claim 3 wherein said first and second valves are interconnected by an operating mechanism to change conjointly said valves from said first condition to said second condition.

5. A tuyere according to claim 4 wherein said valves include a valve member displaceable between said first and second positions and said operating mechanism includes a linkage to displace said valve members conjointly.

6. A tuyere according to claim 5 wherein said valves are rotary valves and said operating mechanism conjointly rotates said valve members between said first and second positions.

7. A tuyere according to claim 3 wherein, in said first condition, said first valve is operable in said first condition to connect an outlet of one of said passageways to an inlet of the other of said passageways whilst inhibiting flow to a discharge and said second valve connects the other of said outlets to a discharge, thereby permitting sequential flow of coolant through said passageways.

8. A tuyere according to claim 7 wherein said second condition, said first valve disconnects said passageways and permits flow from said one outlet to a discharge and said second valve inhibits flow between said other of said outlets and a discharge.

9. A tuyere according to claim 8 wherein said valves are connected to a common discharge.

* * * * *